United States Patent [19]

Nagai et al.

[11] Patent Number: 4,982,779

[45] Date of Patent: Jan. 8, 1991

[54] SHUT-OFF DEVICE FOR USE IN A GUIDE CONDUIT OF A HORIZONTAL CONTINUOUS CASTING APPARATUS

[75] Inventors: Yoshitaka Nagai, Asahi; Makoto Arase; Norio Ohatake, both of Toyama, all of Japan

[73] Assignee: Yoshida Kogyo K.K., Tokyo, Japan

[21] Appl. No.: 492,800

[22] Filed: Mar. 9, 1990

[30] Foreign Application Priority Data

Mar. 17, 1989 [JP] Japan ..... 1-29709[U]

[51] Int. Cl.[5] ..... B22D 11/10; B22D 11/18

[52] U.S. Cl. ..... 164/152; 164/155; 222/54; 222/597; 222/602

[58] Field of Search ..... 164/152, 153, 155, 453, 164/457, 150; 222/597, 598, 599, 600, 601, 602, 54

[56] References Cited

U.S. PATENT DOCUMENTS

| | | | |
|---|---|---|---|
| 3,834,445 | 9/1974 | Raschke | 164/152 X |
| 4,286,647 | 9/1981 | Honda et al. | 164/153 |
| 4,461,336 | 7/1984 | Remeika | 164/155 |
| 4,553,604 | 11/1985 | Yaji et al. | 164/453 |
| 4,556,099 | 12/1985 | Yamamoto et al. | 164/155 X |
| 4,643,242 | 2/1987 | Bryson | 164/153 |

FOREIGN PATENT DOCUMENTS

| | | | |
|---|---|---|---|
| 62-72454 | 4/1987 | Japan | 164/150 |
| 555976 | 6/1977 | U.S.S.R. | 164/150 |

*Primary Examiner*—Richard K. Seidel
*Assistant Examiner*—J. Reed Batten, Jr.
*Attorney, Agent, or Firm*—Flynn, Thiel, Boutell & Tanis

[57] ABSTRACT

The shut-off device includes (1) a stopper capable of blocking a stream of melt flowing in the guide conduit which introduces the melt from a furnance into a tundish therethrough, if the occasion arises, and (2) a receiving plate disposed below a cooling mold so as to receive a leakage melt and having a heat sensor, the heat sensor being adapted to detect the heat of the leakage melt and communicating with a converter for transmitting an operation signals to the stopper. In such a specially designed structure, if the melt breaks out of the cooling mold, the leaked melt is received by the receiving plate and its heat is detected by the heat sensor. According to the detection of the heat, corresponding electric signals are instantly transmitted from the converter to the stopper and thereby the stopper is actuated so as to block the melt flow in the guide conduit.

1 Claim, 2 Drawing Sheets

SHUT-OFF DEVICE FOR USE IN A GUIDE CONDUIT OF A HORIZONTAL CONTINUOUS CASTING APPARATUS

BACKGROUND OF THE INVENTION

1. Field of the Invention

The present invention relates to a shut-off device used when break-out of melt occurs in a horizontal continuous casting apparatus.

2. Description of the Prior Art

In a continuous casting process using a horizontal continuous casting apparatus, melt suddenly breaks out of a cooling mold in the stage of the starting of casting or during the casting process. Such undesirable sudden accidents are ascribable to the entering of a high temperature melt, failures in solidification, excessively increased casting rate, etc.

Heretofore, the break-out of melt has been visually detected and when the break-out occurs, a conduit or a passageway of the melt flow is blocked immediately by manually inserting a stopper therein in order to prevent further break-out of a large quantity of the melt.

In a such conventional apparatus, when operators are working away from the apparatus, the foregoing accidents can not be immediately found. Therefore, a large amount of melt bleeds and the used apparatus and its surrounding area are seriously damaged. In addition to the inconvenience, further disastrous accidents, such as steam explosion, may be also caused.

SUMMARY OF THE INVENTION

An object of the present invention, therefore, is to minimize the foregoing damages encountered in the prior art by detecting quickly the above-mentioned sudden break-out of melt and automatically obturating a melt flow path.

According to the present invention, there is provided a shut-off device for use in a guide conduit of a horizontal continuous casting apparatus, including (1) a stopper capable of blocking a stream of melt flowing in a guide conduit which introduces the stream of the melt from a furnace into a tundish therethrough, if the occasion arises, and (2) a receiving plate disposed below a cooling mold so as to receive a leakage melt and having a heat sensor, the heat sensor being adapted to detect the heat of the leakage melt and communicating with a converter for transmitting operating signals to the stopper.

In such a specially designed structure, if the melt breaks out of the cooling mold, the leaked melt drops to the receiving plate and its heat is detected by the heat sensor. According to the detection of the heat, corresponding electric signals are instantly transmitted from the converter to the stopper and thereby the stopper is actuated so as to block the melt flowing through the guide conduit.

DETAILED DESCRIPTION OF THE PREFERRED EMBODIMENT

The preferred embodiment of the present invention will now be more specifically described below with reference to the accompanying drawings.

Figure 1:
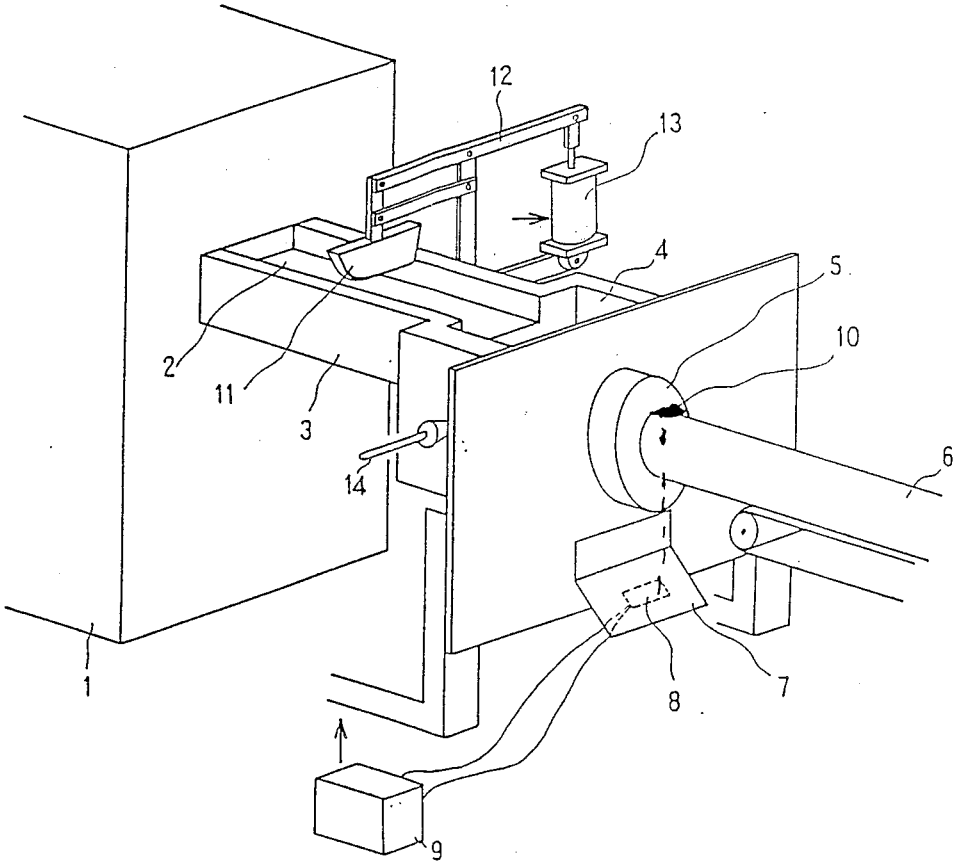
FIG. 1 is a perspective view showing an embodiment of the present invention.

FIG. 1 is a schematic view illustrating the preferred embodiment. In FIG. 1, reference numeral 1 indicates a furnace. Melt 2 contained in the furnace 1 flows into a tundish 4 through a guide conduit 3 and is continuously cast into ingots 6 through a cooling mold 5. Reference numeral 7 indicates a receiving plate adapted to receive a leakage flow of the melt 2 and a thermocouple 8 is disposed on the back of the receiving plate 7. When a bleeding melt 10 falls onto the receiving plate 7, an electrical signal produced by the heat of the melt 10 is transmitted to a converter 9. According to the received electrical signal, the converter 9 transmits a corresponding operation signal to a stopper 11 disposed in the vicinity of the guide conduit 3. The stopper 11 is connected to a cylinder 13 via a lever 12. The cylinder 13 is so designed as to be actuated by the operation signal delivered from the converter 9.

In FIG. 1, reference numeral 14 indicates a plug for discharging remaining melt from the tundish 4. After taking care of accidents, the plug 14 is pulled out and the melt remaining in the tundish is discharged.

Figure 2:
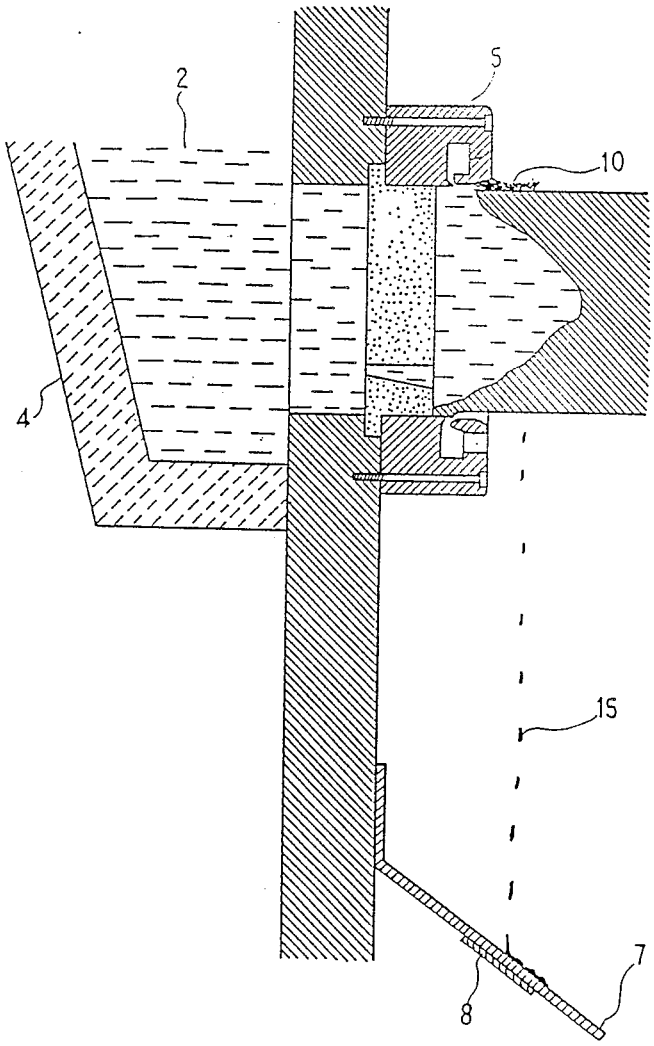
FIG. 2 is a sectional view illustrating the main part of the embodiment.

FIG. 2 is a sectional view showing the important part. The melt 10 which breaks out of the cooling mold 5 for some reason falls as droplets 15 onto the melt receiving plate 7 and the heat of the melt droplets 15 is detected by the thermocouple 8 disposed on the back of the receiving plate 7. The receiving plate 7 is so inclined as to permit the melt droplets 15 to flow immediately when break-out occurs and a vessel receiving the flowing melt is located at an appropriate position of the lower end of the receiving plate 7.

According to the present invention, since breakout of melt can be readily and automatically detected, the casting operation can be safely and securely conducted. Furthermore, since the melt flow pathway can be automatically shut off, the casting operations can be conducted without requiring human labour. Since the heat of melt breaking out of a cooling mold is directly detected as temperature changes of the receiving plate, the detection is instantaneous and precise as compared with the detection by a radiation thermometer or the like which is disposed out of contact with the receiving plate. Therefore, casting operations can be conducted without wrong operations which may be caused due to cooling water, steam, etc. Furthermore, even any slight break-out of melt from the lower part of the cooling mold which can be hardly detected by visual observation can be surely detected and proper treatments can be immediately taken for the accidents.

What is claimed is:

1. In a horizontal continuous casting apparatus, a shut-off device for use in a guide conduit of the horizontal continuous casting apparatus, including (1) a stopper capable of blocking a stream of melt flowing in said guide conduit which introduces said stream of melt from a furnace into a tundish therethrough, and (2) a receiving plate disposed below a cooling mold so as to receive a leakage melt and having a heat sensor, said heat sensor being adapted to detect heat from said leakage melt and communicating with a converter for transmitting operation signals to said stopper.

* * * * *